US008022633B2

(12) United States Patent
Koyama

(10) Patent No.: US 8,022,633 B2
(45) Date of Patent: Sep. 20, 2011

(54) DISPLAY DEVICE USING ELECTRON SOURCE ELEMENTS AND METHOD OF DRIVING SAME

(75) Inventor: Jun Koyama, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 13/025,190

(22) Filed: Feb. 11, 2011

(65) Prior Publication Data

US 2011/0134098 A1 Jun. 9, 2011

Related U.S. Application Data

(60) Continuation of application No. 11/528,545, filed on Sep. 28, 2006, now Pat. No. 7,888,878, which is a division of application No. 10/971,131, filed on Oct. 25, 2004, now Pat. No. 7,116,057, which is a division of application No. 10/191,291, filed on Jul. 10, 2002, now Pat. No. 6,815,901.

(30) Foreign Application Priority Data

Jul. 12, 2001 (JP) ..... 2001-211758

(51) Int. Cl.
*G09G 3/10* (2006.01)

(52) U.S. Cl. ..... 315/169.1; 315/169.3; 345/74.1; 345/80; 345/90

(58) Field of Classification Search .... 315/169.1–169.3, 315/167; 345/74.1, 76, 77, 80, 90, 92, 93, 345/97, 98, 204–206, 214
See application file for complete search history.

(56) References Cited

U.S. PATENT DOCUMENTS 5,153,483 A 10/1992 Kishino et al.
(Continued)

FOREIGN PATENT DOCUMENTS

EP 0 653 741 A1 5/1995
(Continued)

OTHER PUBLICATIONS

M. Sagawa et al., "Novel Device Structure of MIM Cathode Array for Field Emission Displays", SID 2001, pp. 193-195.

*Primary Examiner* — Haissa Philogene
(74) *Attorney, Agent, or Firm* — Nixon Peabody LLP; Jeffrey L. Costellia

(57) ABSTRACT

In the case where the number of pixels is increased in a display device making use of electron source elements, a period, in which one pixel is caused to continue to emit light, shortened, and so there is caused a need of applying a high voltage between upper and lower electrodes of an electron source element in a short period. Therefore, there is caused a problem that a drive circuit is made severe in operating condition and so the display device is degraded in reliability. Two TFTs are arranged on each of pixels. Also, a time gradation system is used, in which one frame period is divided into a plurality of sub-frame periods, a light emitting or non-emitting state of each of the pixels is selected in the respective sub-frame periods, and gradation is represented by adding up periods, in which the light emitting state is selected in the respective sub-frame periods. Thus it is possible to provide a display device having a high reliability and a method of driving the same.

20 Claims, 13 Drawing Sheets

U.S. PATENT DOCUMENTS

| | | | | |
|---|---|---|---|---|
| 5,402,041 | A | 3/1995 | Kishino et al. | |
| 5,670,792 | A | 9/1997 | Utsugi et al. | |
| 5,684,365 | A | 11/1997 | Tang et al. | |
| 5,786,795 | A | 7/1998 | Kishino et al. | |
| 5,945,972 | A * | 8/1999 | Okumura et al. | 345/98 |
| 5,990,629 | A | 11/1999 | Yamada et al. | |
| 6,023,308 | A | 2/2000 | Takemura | |
| 6,069,598 | A | 5/2000 | Hansen | |
| 6,100,637 | A | 8/2000 | Kishino et al. | |
| 6,157,356 | A | 12/2000 | Troutman | |
| 6,246,180 | B1 | 6/2001 | Nishigaki | |
| 6,246,384 | B1 | 6/2001 | Sano | |
| 6,522,066 | B2 | 2/2003 | Sheu et al. | |
| 6,522,315 | B2 | 2/2003 | Ozawa et al. | |
| 6,525,704 | B1 | 2/2003 | Kondo et al. | |
| 6,580,408 | B1 | 6/2003 | Bae et al. | |
| 6,583,775 | B1 | 6/2003 | Sekiya et al. | |
| 6,815,901 | B2 | 11/2004 | Koyama | |
| 6,858,989 | B2 | 2/2005 | Howard | |
| 6,870,192 | B2 | 3/2005 | Yamazaki et al. | |
| 7,116,057 | B2 * | 10/2006 | Koyama | 315/169.1 |
| 7,250,928 | B2 | 7/2007 | Yamazaki et al. | |
| 7,888,878 | B2 * | 2/2011 | Koyama | 315/169.1 |

FOREIGN PATENT DOCUMENTS

| | | | |
|---|---|---|---|
| EP | 1 061 497 | A1 | 12/2000 |
| JP | 56-086757 | | 7/1981 |
| JP | 03-295138 | | 12/1991 |
| JP | 05-249495 | | 9/1993 |
| JP | 05-275701 | | 10/1993 |
| JP | 06-044927 | | 2/1994 |
| JP | 07-111341 | | 4/1995 |
| JP | 07-114896 | | 5/1995 |
| JP | 08-328037 | | 12/1996 |
| JP | 09-114414 | | 5/1997 |
| JP | 09-305139 | | 11/1997 |
| JP | 10-333641 | | 12/1998 |
| JP | 2000-221942 | | 8/2000 |
| JP | 2000-310792 | | 11/2000 |
| JP | 2000-347621 | | 12/2000 |
| JP | 2001-042822 | | 2/2001 |
| JP | 2001-060076 | | 3/2001 |
| JP | 2001-084927 | | 3/2001 |
| JP | 2001-142427 | | 5/2001 |
| JP | 2002-297083 | | 10/2002 |
| TW | 474038 | | 1/2002 |
| WO | WO 98/33165 | | 7/1998 |

* cited by examiner

DISPLAY DEVICE USING ELECTRON SOURCE ELEMENTS AND METHOD OF DRIVING SAME

This application is a Continuation of U.S. application Ser. No. 11/528,545 filed Sep. 28, 2006 now U.S. Pat. No. 7,888,878, which is a Division of U.S. application Ser. No. 10/971,131 filed Oct. 25, 2004 now U.S. Pat. No. 7,116,057, and which is a Division of U.S. application Ser. No. 10/191,291 filed Jul. 10, 2002 now U.S. Pat. No. 6,815,901

BACKGROUND OF THE INVENTION

1. Field of the Invention

The invention relates to a display device (referred below to an FED (Field Emission Display)), which makes use of electron source elements (electron emitting elements). Also, the invention relates to a method of driving the FED. Further, the invention relates to an electronic equipment making use of the FED.

2. Description of the Related Art

An explanation will be given to an FED (Field Emission Display) making use of an electron source element. Here, an element emitting electrons owning to the electric field effect is referred to as an electron source element.

Electron source elements arranged on respective pixels of the FED emit electrons from electrodes due to the electric field effect. Electrons thus emitted are accelerated to be incident upon a fluorescent body. The fluorescent body in a region, upon which electrons are incident, emits light. A quantity of electrons emitted from the electron source elements on the respective pixels is controlled by a video signal input into the FED. The more electrons emitted, the higher emission luminance of the fluorescent body in the case where these electrons are incident upon the fluorescent body. Thus the FED represents gradation.

Electron source elements have various configurations. There are typically given an FE (Field Emission) type element for causing electrons to be emitted from a tip end of a convex electrode where an intense electric field is locally generated, a surface conduction type element for causing generation of electrons through flowing of an electric current in parallel to a thin film surface broken locally, an MIM (Metal-Insulator-Metal) type element composed of a first electrode, a second electrode and an insulating film interposed between the first electrode and the second electrode, and for emitting electrons upon application of voltage between the first electrode and the second electrode.

Here, what is regarded as important in electron source elements used in FEDs is whether elements can be made minute, or whether elements having a uniform performance can be fabricated, or whether elements can be driven with low voltage. Hereupon, MIM type electron source elements meeting these qualifications have been developed.

FIG. 6 shows an example of an MIM type electron source element. Its structure is described in SID 01 Digest page 193-195 "Novel Device Structure of MIM Cathode Array for Field Emission Displays".

In FIG. 6, formed on a substrate 20 with an insulating surface are a lower electrode 21, an upper electrode 23, and an insulating film 22 interposed between the lower electrode 21 and the upper electrode 23. Also, the reference numeral 24 denotes a protective insulating layer, 25*a* a contact electrode, 25*b* an upper electrode bus line, and 26 a protective electrode. In addition, a region where the upper electrode 23 overlaps an opening of the protective insulating layer 24 is referred to as an electron emission region and denoted by the reference numeral 27 in the figure.

Application of voltage between the upper electrode 23 and the lower electrode 21 causes injection of a hot carrier into the insulating film 22. That hot carrier of the hot carrier thus injected, which has a greater energy than a work function of a material of the upper electrode 23, passes through the upper electrode 23 to be emitted into the vacuum.

An MIM type electron source element having the structure shown in FIG. 6 emits electrons when voltage of around 10 V is applied between the upper electrode 23 and the lower electrode 21. In electron source elements, voltage applied between an upper electrode and a lower electrode when electrons are emitted is referred to as a drive voltage of an electron source element. An upper electrode of electron source elements is set to be high in electric potential as compared with a lower electrode thereof. In this manner, electrons are emitted from the upper electrode.

FIG. 7 shows an example of a display (FED) making use of the electron source element shown in FIG. 6. In addition, the same parts as those in FIG. 6 are denoted by the same reference numerals.

The FED shown in FIG. 7 has on the first substrate 20 with an insulating surface x (natural number) signal lines S1 to Sx arranged in a row direction, and v (natural number) scanning lines G1 to Gy arranged in a column direction. Electron source elements are arranged on respective points of intersection of the x signal lines S1 to Sx and the y scanning lines G1 to Gy. One electron source element, and that part of the signal lines and the scanning lines, to which the electron source element is connected, constitute one pixel. In FIG. 7, the reference numeral 300 denotes one pixel. The lower electrode 21 of the electron source element is connected to one of the y scanning lines G1 to Gy, and the upper electrode 23 is connected to one of the x signal lines S1 to Sx.

In addition, the lower electrode 21 may be connected to one of the x signal lines S1 to Sx and the upper electrode 23 may be connected to one of the y scanning lines G1 to Gy.

A second substrate 19 is provided to face that surface of the first substrate 20, on which the electron source element is provided. The second substrate 19 is light-transmissive. Arranged on the second substrate 19 is a fluorescent body 18 opposite to the electron source element. A black matrix 15 is arranged around the fluorescent body 18. In addition, the fluorescent body 18 is formed on a surface thereof with a metal-backed layer 17. Vacuum is kept between the first substrate and the second substrate.

A signal input into the scanning lines and a signal input into the signal lines cause emission of electrons from the upper electrode 23 in the electron source element of the pixel, in which voltage is applied between the upper electrode 23 and the lower electrode 21. Electrons thus emitted are accelerated in the vacuum 16 by voltage applied between the metal-backed layer 17 and the upper electrode. Electrons thus accelerated are incident upon the fluorescent body 18 provided on the second substrate 19 through the metal-backed layer 17. Thus the fluorescent body 18 in a region where electrons are incident emits light.

Here, a signal input into, for example, the scanning lines are kept constant in amplitude, and a signal input into the signal lines is varied in amplitude. A quantity of electrons emitted from the electron source element 28 is increased in accordance with voltage applied between the upper electrode 23 and the lower electrode 21. The more electrons emitted, the higher emission luminance can be represented in the case where these electrons are accelerated to be incident upon the fluorescent body 18 on the second substrate 19.

FIG. 8 shows a timing chart in the case where the display having the structure shown in FIG. 7 is driven. In the timing chart, one frame period (F) is a period, in which one picture image is displayed.

First, a scanning line G1 is selected. Here, other scanning lines G2 to Gy are put in a state, in which they are not selected. In addition, selection of a scanning line in FIGS. 7 and 8 means putting a scanning line connected to one of electrodes of an electron source element in a certain electric potential so that a quantity of electrons emitted from the electron source element is varied in accordance with an electric potential input into a signal line connected to the other of the electrodes of the electron source element.

For example, suppose that an electric potential of −8 V is input into a scanning line as selected in the case where a scanning line is connected to the lower electrode 21 of the electron source element and a signal line is connected to the upper electrode 23. On the other hand, suppose that an electric potential of 8 V is input into scanning lines as not selected. Also, suppose that an electric potential of −8 to 8 V is input into a signal line. Here, suppose that the upper electrode 23 of the electron source element emits electrons when the upper electrode 23 of the electron source element is higher about 10 V in electric potential than the lower electrode 21. At this time, the electron source element emits electrons when a signal electric potential of 5V from the signal line is input into the upper electrode 23 of the electron source element, of which the lower electrode 21 is connected to a scanning line in a selected state. Meanwhile, even when a signal electric potential of 5 V is input into the upper electrode 23 of the electron source element, of which the lower electrode 21 is connected to a scanning line in a non-selected state, the upper electrode 23 of the electron source element is lower in electric potential than the lower electrode 21 and so electrons are not emitted.

A period, in which the scanning line G1 is selected, is referred to as a first line period (L1). At this time, signals are successively input into the signal lines S1 to Sx. The electron source element emits electrons from the upper electrode 23 in accordance with signals as input. Thus emitted electrons cause the fluorescent body 18 provided on the opposed substrate 19 (second substrate) to emit light. In this manner, pixels in the first column emit light in accordance with signals as input. Subsequently, a scanning line G2 is selected. Here, G1. G3 to Gy are in a non-selected state. A period, in which the scanning line G2 is selected, is referred to as a second line period (L2). At this time, signals are successively input into the signal lines S1 to Sx. The electron source element 28 emits electrons from the upper electrode 23 in accordance with signals as input. Thus emitted electrons cause the fluorescent body 18 provided on the opposed substrate 19 (second substrate) to emit light. In this manner, pixels in the second column emit light in accordance with signals as input. The same action is repeated for all the gate signal lines, and so the one frame period is terminated. Thus the FED represents a picture image.

Since the above drive method is a passive type one, however, signals are directly input into electrodes of electron source elements of those pixels, on which display device should not be made. Therefore, there is involved a problem that power consumption is increased.

Hereupon, Japanese Patent Laid-Open No. 84927/2001 proposes an FED, in which a thin-film transistor (referred below to as a TFT) is arranged on each pixel. The constitution of this FED is shown in FIG. 9. FIG. 9 schematically shows electron source elements 902. The reference numeral 903 denotes lower electrodes, and 904 upper electrodes.

In FIG. 9, one of a source region and a drain region of a TFT 901 (referred below to as a pixel TFT) arranged every pixel is connected to one of x (natural number) signal lines S1 to Sx, and the other of the regions the lower electrode 903 of the electron source element 902. Also, a gate electrode of the pixel TFT 901 is connected to one of y (natural number) scanning lines G1 to Gy. The upper electrode 904 of the electron source element 902 is kept at a certain electric potential $V_{com}$.

A selection signal is input into the scanning lines G1 to Gy. A pixel TFT 901 connected to a scanning line, into which a selection signal is input, is made ON. A signal input into a signal line is input into the lower electrode 903 of the electron source element 902 through the pixel TFT 901 having been made ON.

The electron source element 902 emits electrons due to a difference between an electric potential of the signal input into the lower electrode 903 and an electric potential of the upper electrode 904. Thus emitted electrons cause the fluorescent body to emit light, and so the pixel emits light. In addition, when the electron source element 902 emits electrons from the upper electrode 904, the upper electrode 904 is kept higher in electric potential than the lower electrode 903.

Power (reactive power) consumed in those pixels, in which display device should not be made (signals are not input into both scanning lines and signal lines), can be significantly reduced in a display device constructed such that the pixel TFT 901 is arranged in each pixel and a signal from a signal line is input into the lower electrode 903 of the electron source element 902 only in a pixel, in which the pixel TFT 901 is made ON.

An MIM type electron source element emits electrons when voltage is applied between an upper electrode and a lower electrode. Therefore, with pixels of a display device constructed in the manner described in Japanese Patent Laid-Open No. 84927/2001, voltage is applied between the upper electrode 904 and the lower electrode 903 of the electron source element 902 in a pixel, in which a signal is input into a scanning line to make the pixel TFT 901 ON, only for a period of time, during which a signal is input into a signal line, whereby electrons are emitted. Electrons are input into a fluorescent body only for a period of time, during which electrons are emitted, to cause a pixel emitting light.

For example, in the case where signals are input one pixel by one pixel from signal lines (dot sequential drive), a period of time, during which one pixel emits light, becomes equal to or less than 1/L of one frame period where the number of pixels possessed by a display device is L. Also, in the case where signals are input into all pixels in one column at the same time, that is, signals are input into pixels in one column at the same time from source signal lines S1 to Sx (line sequential drive), a period of time, during which one pixel emits light, becomes equal to or less than 1/y of one frame period assuming that a display possesses pixels of y columns.

Here, in the case where a display device such as large-sized displays, highly fine displays, or the like has a large number of pixels, a period of time, during which one pixel continues to emit light, becomes short in a display, in which pixels are constructed in the above mariner. Therefore, when it is tried to represent an adequate luminance during one frame period, it becomes necessary to apply a high voltage between an upper electrode and a lower electrode of an electron source element in a short period of time. Therefore, a drive circuit is increased in drive voltage and load on elements, which constitute the drive circuit, becomes large. Therefore, there is caused a problem that a display device is degraded in reliability.

Also, in order to input analog signals into signal lines S1 to Sx, a plurality of signal voltages must be set to meet respective graduations. Therefore, there is caused a problem that such construction is not suited to multi-graduations.

SUMMARY OF THE INVENTION

Hereupon, the invention has its object to realize action with low power consumption, high reliability and multi-graduations in an FED.

Arranged on respective pixels are an electron source element, a first TFT, second TFT, and a capacitor element. The first TFT is referred to as a switching TFT, and the second TFT is referred to as a drive TFT.

A gate electrode of the switching TFT is connected to a scanning line, and one of a source region and a drain region of the switching TFT is connected to a signal line, the other being connected to a gate electrode of the drive TFT and one of electrodes of the capacitor element (storage capacitor). The other electrode of the capacitor element is connected to a power feed line. One of a source region and a drain region of the drive TFT is connected to a power feed line, and the other is connected to one of electrodes of the electron source element.

In addition, in the case of making positive use of a parasitic capacitance of a gate of the drive TFT, the above capacitor element is not necessary needed.

With the pixel constructed in the above manner, a signal electric potential is input into the gate electrode of the drive TFT through between source drains of the switching TFT. Here, the capacitor element (storage capacitor) preserves a gate voltage of the drive TFT having been varied by the signal electric potential as input.

The drive TFT having been made ON by the signal electric potential input into the gate electrode imparts a predetermined electric potential to one of electrodes of the electron source element through between source drains thereof. For example, electric potential substantially equivalent to electric potential of the power feed line. In this manner, voltage is applied between an upper electrode and a lower electrode of the electron source element, which in turn emits electrons. Here, voltage held by the storage capacitor continues to be preserved until a signal is input through the switching TFT from a signal line. In the meantime, the electron source element continues to emit electrons, and the pixel associated therewith continues to emit light.

With the above constitution, a signal once input into a pixel is preserved and so the pixel continues to emit light. Therefore, it becomes possible to set a light emitting period per one frame period to be long. In this manner, it is possible to decrease luminance per unit time. That is, voltage applied between both electrodes (upper electrode and lower electrode) of the electron source element can be set to be low. Accordingly, a display can be realized, which acts with low power consumption. Also, in the event of using the above drive method, since signal output having a high amplitude voltage is not required for a drive circuit, load on elements constituting the drive circuit is small. Thus it is possible to realize a display with high reliability.

Also, the time gradation system may be used in a display device having a pixel of the above constitution. In the time gradation system, one frame period is divided into a plurality of sub-frame periods, and a ON or OFF state of a drive TFT of respective pixels is selected in respective sub-frame periods, so that a light emitting or non-emitting state of respective pixels is selected. In a particular pixel, luminance is represented by adding up periods, in which a light emitting state is selected in one frame period.

With the above drive method, the number of gradations can be optionally set in accordance with a way to divide sub-frame periods. Therefore, the method is suited to multi-graduations as compared with a display device, in which voltage is varied stepwise to represent gradations.

In this manner, it is possible to realize action with low power consumption, multi-graduations and high reliability in an FED.

Examples of the constitution of a display device according to the invention and of a method of the same will be enumerated.

A display device according to the invention having an electron source element, from which electrons are emitted by applying a voltage between a first electrode and a second electrode, has a feature in that it comprises a capacitor element, a first signal line, a first switch, by which connection of one of electrodes of the capacitor element and the first signal line is selected, a second switch, which is switched over between ON and OFF in accordance with a voltage preserved in the capacitor element, and a second signal line connected to the first electrode of the electron source element through the second switch.

A display device according to the invention having an electron source element, from which electrons are emitted by applying a voltage between a first electrode and a second electrode, has a feature in that it comprises a capacitor element, a first signal line, a switch, by which connection of one of electrodes of the capacitor element and the first signal line is selected, and an element for varying an electric potential of the first electrode of the electron source element in accordance with a voltage preserved in the capacitor element.

A display device according to the invention having an electron source element, from which electrons are emitted by applying a voltage between a first electrode and a second electrode, has a feature in that it comprises a capacitor element, a first signal line, a first switch, by which connection of one of electrodes of the capacitor element and the first signal line is selected, a second switch, which is switched over between ON and OFF in accordance with a voltage preserved in the capacitor element, and a third switch for short-circuiting two electrodes of the capacitor element.

The electron source element is composed of the first and second electrodes, and an insulating layer between the first and second electrodes.

A display device according to the invention having an electron source element, from which electrons are emitted by applying a voltage between a first electrode and a second electrode, has a feature in that it comprises a first signal line, a second signal line, a third signal line, a first TFT, and a second TFT, and that a gate electrode of the first TFT is connected to the second signal line, and that one of a source region and a drain region of the first TFT is connected to a gate electrode of the second TFT, the other being connected to the first signal line, and one of a source region and a drain region of the second TFT is connected to the third signal line, the other being connected to the first electrode of the electron source element.

A display device according to the invention having an electron source element, which is composed of a first electrode, a second electrode, and an insulating layer between the first electrode and the second electrode, and in which the first electrode is higher in electric potential than the second electrode and the first electrode emits electrons, has a feature in that it comprises a first signal line, a second signal line, a third signal line, a first TFT, and a second TFT, and a gate electrode of the first TFT is connected to the second signal line, and that one of a source region and a drain region of the first TFT is connected to a gate electrode of the second TFT, the other being connected to the first signal line, and one of a source region and a drain region of the second TFT is connected to the third signal line, the other being connected to the second electrode of the electron source element.

A display device according to the invention having an electron source element, which is composed of a first electrode, a second electrode, and an insulating layer between the first electrode and the second electrode, and in which the first electrode is higher in electric potential than the second electrode and the first electrode emits electrons, has a feature in that it comprises a first signal line, a second signal line, a third signal line, a first TFT, and a second TFT, and a gate electrode of the first TFT is connected to the second signal line, and that one of a source region and a drain region of the first TFT is connected to a gate electrode of the second TFT, the other being connected to the first signal line, and one of a source region and a drain region of the second TFT is connected to the third signal line, the other being connected to the first electrode of the electron source element.

The display device has a feature in that it comprises a capacitor element provided between a third electrode and a fourth electrode to preserve voltage, and that the third electrode is connected to the third signal line, and the fourth electrode is connected to a gate electrode of the second TFT.

A display device according to the invention having an electron source element, in which voltage is applied between a first electrode and a second electrode to emit electrons, has a feature in that it comprises a first signal line, a second signal line, a third signal line, a fourth signal line, a first TFT, a second TFT, a third TFT, and a capacitor element provided between a third electrode and a fourth electrode to preserve voltage, and a gate electrode of the first TFT is connected to the second signal line, that one of a source region and a drain region of the first TFT is connected to a gate electrode of the second TFT, the other being connected to the first signal line, one of a source region and a drain region of the second TFT being connected to the third signal line, the other being connected to the first electrode of the electron source element, and a gate electrode of the third TFT is connected to the fourth signal line, and that one of a source region and a drain region of the third TFT is connected to the third electrode of the capacitor element, the other being connected to the third signal line, the fourth electrode of the capacitor element being connected to the third signal line.

A display device according to the invention having an electron source element, which is composed of a first electrode, a second electrode, and an insulating layer between the first electrode and the second electrode, and in which the first electrode is higher in electric potential than the second electrode and the first electrode emits electrons, has a feature in that it comprises a first signal line, a second signal line, a third signal line, a fourth signal line, a first TFT, a second TFT, a third TFT, and a capacitor element provided between a third electrode and a fourth electrode to preserve voltage, and a gate electrode of the first TFT is connected to the second signal line, that one of a source region and a drain region of the first TFT is connected to a gate electrode of the second TFT, the other being connected to the first signal line, one of a source region and a drain region of the second TFT being connected to the third signal line, the other being connected to the second electrode of the electron source element, and a gate electrode of the third TFT is connected to the fourth signal line, and that one of a source region and a drain region of the third TFT is connected to the third electrode of the capacitor element, the other being connected to the third signal line, the fourth electrode of the capacitor element being connected to the third signal line.

A display device according to the invention having an electron source element, which is composed of a first electrode, a second electrode, and an insulating layer between the first electrode and the second electrode, and in which the first electrode is higher in electric potential than the second electrode and the first electrode emits electrons, has a feature in that it comprises a first signal line, a second signal line, a third signal line, a fourth signal line, a first TFT, a second TFT, a third TFT, and a capacitor element provided between a third electrode and a fourth electrode to preserve voltage, and a gate electrode of the first TFT is connected to the second signal line, that one of a source region and a drain region of the first TFT is connected to a gate electrode of the second TFT, the other being connected to the first signal line, one of a source region and a drain region of the second TFT being connected to the third signal line, the other being connected to the first electrode of the electron source element, and a gate electrode of the third TFT is connected to the fourth signal line, and that one of a source region and a drain region of the third TFT is connected to the third electrode of the capacitor element, the other being connected to the third signal line, the fourth electrode of the capacitor element being connected to the third signal line.

An electronic equipment may use the display device.

A method, according to the invention, of driving a display device having an electron source element, from which electrons are emitted by applying a voltage between two electrodes, comprises selectively inputting an electric potential of a signal, which is input into a signal line, into one of electrodes of a capacitor element, to cause the capacitor element to preserve a predetermined voltage. Connection between a power line and one of the electrodes of the electron source element is selected in accordance with a voltage thus preserved. A potential difference is given between an electric potential of the one of the electrodes of the electron source element connected to the power line and an electric potential of the other of the electrodes. Thereby the electron source element emits electrons, and the electric potential thus emitted is incident upon a fluorescent body. Thus the fluorescent body emits light, and pixels are put in a light emitting state.

A method, according to the invention, of driving a display device having an electron source element, from which electrons are emitted by applying a voltage between two electrodes, comprises selectively inputting an electric potential of a signal, which is input into a signal line, into one of electrodes of a capacitor element, to cause the capacitor element to preserve a predetermined voltage. Connection between a power line and one of the electrodes of the electron source element is selected in accordance with a voltage thus preserved. In this manner, a potential difference is given between one of the electrodes of the electron source element connected to the power line and the other of the electrodes. Thereby, the electron source element emits electrons, and the electric potential thus emitted is incident upon a fluorescent body. Thus the fluorescent body emits light, and pixels are put in a light emitting state. A voltage preserved by the capacitor element is discharged to cut off connection between the power line and the one of the electrodes of the electron source element. Thus emission of electrons from the electron source element is stopped to put pixels in a light non-emitting state.

A method, according to the invention, of driving a display device having an electron source element, from which electrons are emitted by applying a voltage between a first electrode and a second electrode, the method comprises using a first signal to select an ON state of a first switch and inputting a second signal into a second switch. Thus an ON state of a second switch is selected. In addition, the state of the second switch is held. A third signal is input into the first electrode of the electron source element through the second switch in the ON state. A potential difference between an electric potential of the one of the electrodes of the electron source element, into which the third signal is input, and an electric potential of the other of the electrodes causes the electron source element to emit electrons, and the electric potential thus emitted is incident upon a fluorescent body. Thus the fluorescent body emits light, and pixels are put in a light emitting state.

A method, according to the invention, of driving a display device making use of an electron source element, from which electrons are emitted by applying a voltage between a first electrode and a second electrode, comprises inputting a first digital signal into a gate electrode of a first TFT to select an ON state of the first TFT. Thus a second digital signal is input through between source/drain of the first TFT in the ON state into a gate electrode of a second TFT. An ON state of the second TFT is selected by the second digital signal. An electric potential of a power source is input into the first electrode of the electron source element through between source/drain of the second TFT in the ON state to provide a predetermined voltage between the first electrode and the second electrode of the electron source element. Thus the electron source element emits electrons, and the electric potential thus emitted is incident upon a fluorescent body. Thus the fluorescent body emits light, and pixels are put in a light emitting state.

The second digital signal may be input into the second TFT several times during one frame period.

A method, according to the invention, of driving a display device having an electron source element, which is composed of a first electrode, a second electrode, and an insulating layer between the first electrode and the second electrode, and in which the first electrode is higher in electric potential than the second electrode and the first electrode emits electrons, comprises inputting a first digital signal into a gate electrode of a first TFT to select an ON state of the first TFT. A second digital signal is input through between source/drain of the first TFT in the ON state into a gate electrode of a second TFT. Thus an ON state of the second TFT is selected. An electric potential of a power source is input into the second electrode of the electron source element through between source/drain of the second TFT in the ON state to provide a predetermined voltage between the first electrode and the second electrode of the electron source element. Thus the electron source element emits electrons, and the electric potential thus emitted is incident upon a fluorescent body. Thus the fluorescent body emits light, and pixels are put in a light emitting state.

A method, according to the invention, of driving a display device having an electron source element, which is composed of a first electrode, a second electrode, and an insulating layer between the first electrode and the second electrode, and in which the first electrode is higher in electric potential than the second electrode and the first electrode emits electrons, comprises inputting a first digital signal into a gate electrode of a first TFT to select an ON state of the first TFT. A second digital signal is input through between source/drain of the first TFT in the ON state into a gate electrode of a second TFT. Thus an ON state of the second TFT is selected. An electric potential of a power source is input into the first electrode of the electron source element through between source/drain of the second TFT in the ON state to provide a predetermined voltage between the first electrode and the second electrode of the electron source element. Thus the electron source element emits electrons, and the electric potential thus emitted is incident upon a fluorescent body. Thus the fluorescent body emits light, and pixels are put in a light emitting state.

The second digital signal may be input into the second TFT several times during one frame period.

A gate voltage of the second TFT determined by the second digital signal may be preserved by a parasitic capacitance portion between the gate electrode and a source region or a drain region of the second TFT.

A method, according to the invention, of driving a display device making use of an electron source element, from which electrons are emitted by applying a voltage between a first electrode and a second electrode, comprises inputting a first digital signal into a gate electrode of a first TFT to select an ON state of the first TFT. A second digital signal is input through between source/drain of the first TFT in the ON state into a gate electrode of a second TFT to select an ON state of the second TFT. A capacitor element is used to preserve a gate voltage of the second TFT determined by the second digital signal. A predetermined electric potential of a power source is input into the first electrode of the electron source element through between source/drain of the second TFT in the ON state. A predetermined voltage is given between the first electrode and the second electrode of the electron source element. Thus the electron source element emits electrons, and the electric potential thus emitted is incident upon a fluorescent body. Thus the fluorescent body emits and pixels are put in a light emitting state. Also, a third TFT, which is connected in parallel to the capacitor element, is made ON to thereby discharge charge preserved by the capacitor element. Thus the second TFT is put in an OFF state, and the electron source element is caused not to emit electrons. Then pixels are put in a light non-emitting state.

An electronic equipment may use a method of driving the above display device.

DETAILED DESCRIPTION OF THE PREFERRED EMBODIMENTS

Figure 1:
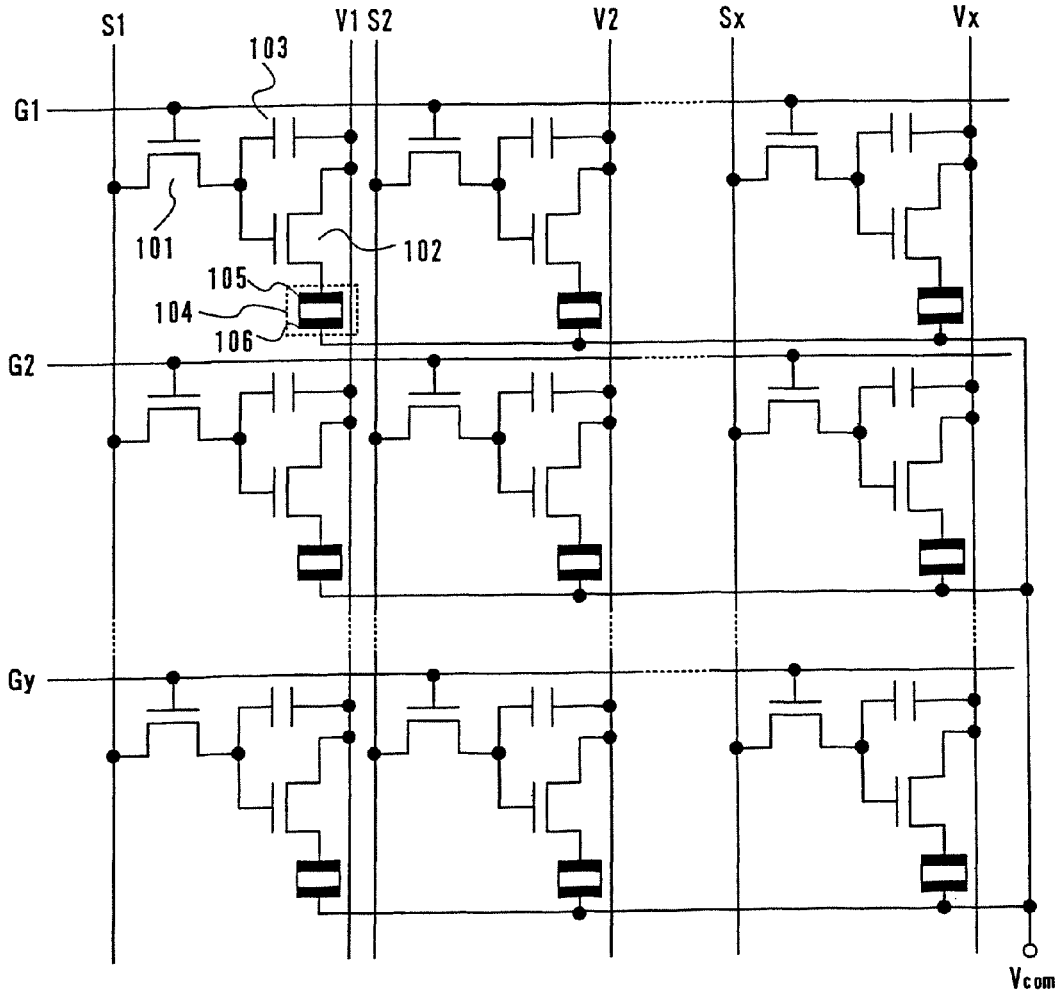
FIG. 1 is a view showing the structure of pixel regions in a display device according to the invention.

The constitution of a display device according to the invention will be described with reference to FIG. 1. In FIG. 1, an electron source element is schematically denoted by the reference numeral 104. The reference numerals 105, 106 denote two electrodes, which constitute the electron source element.

Figure 6:
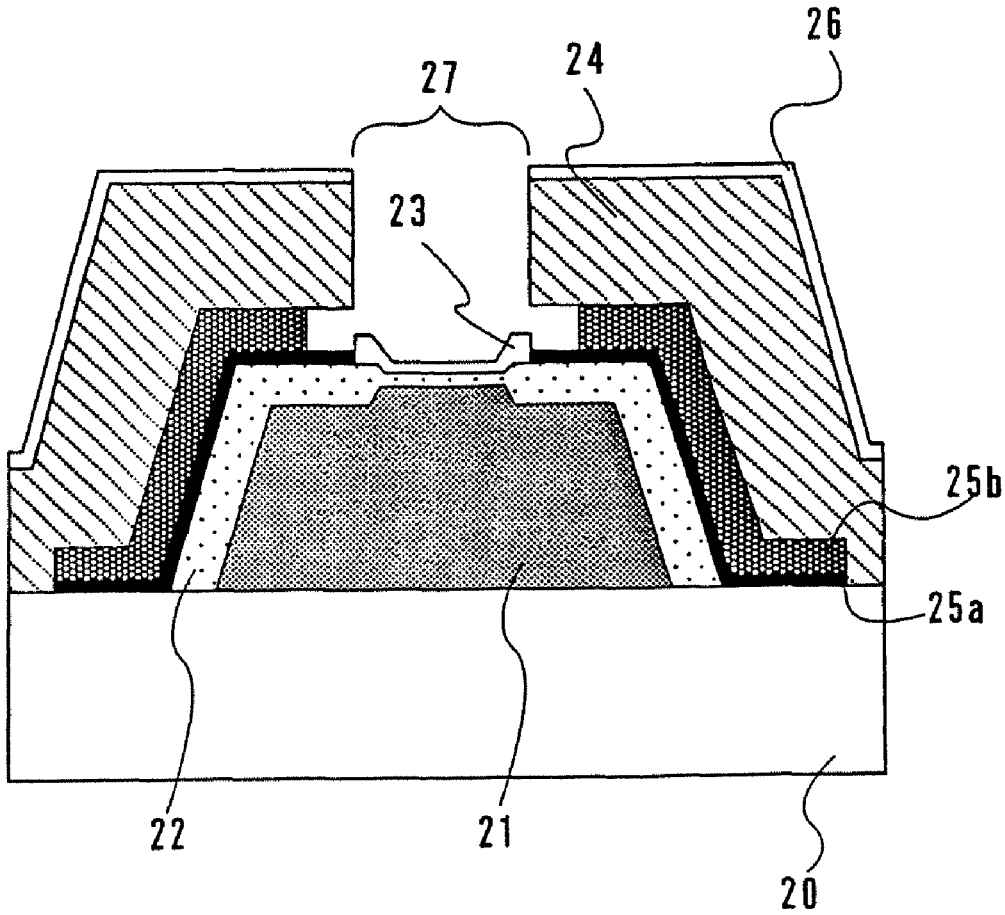
FIG. 6 is a view showing the constitution of a MIM type electron source element.
Figure 7:
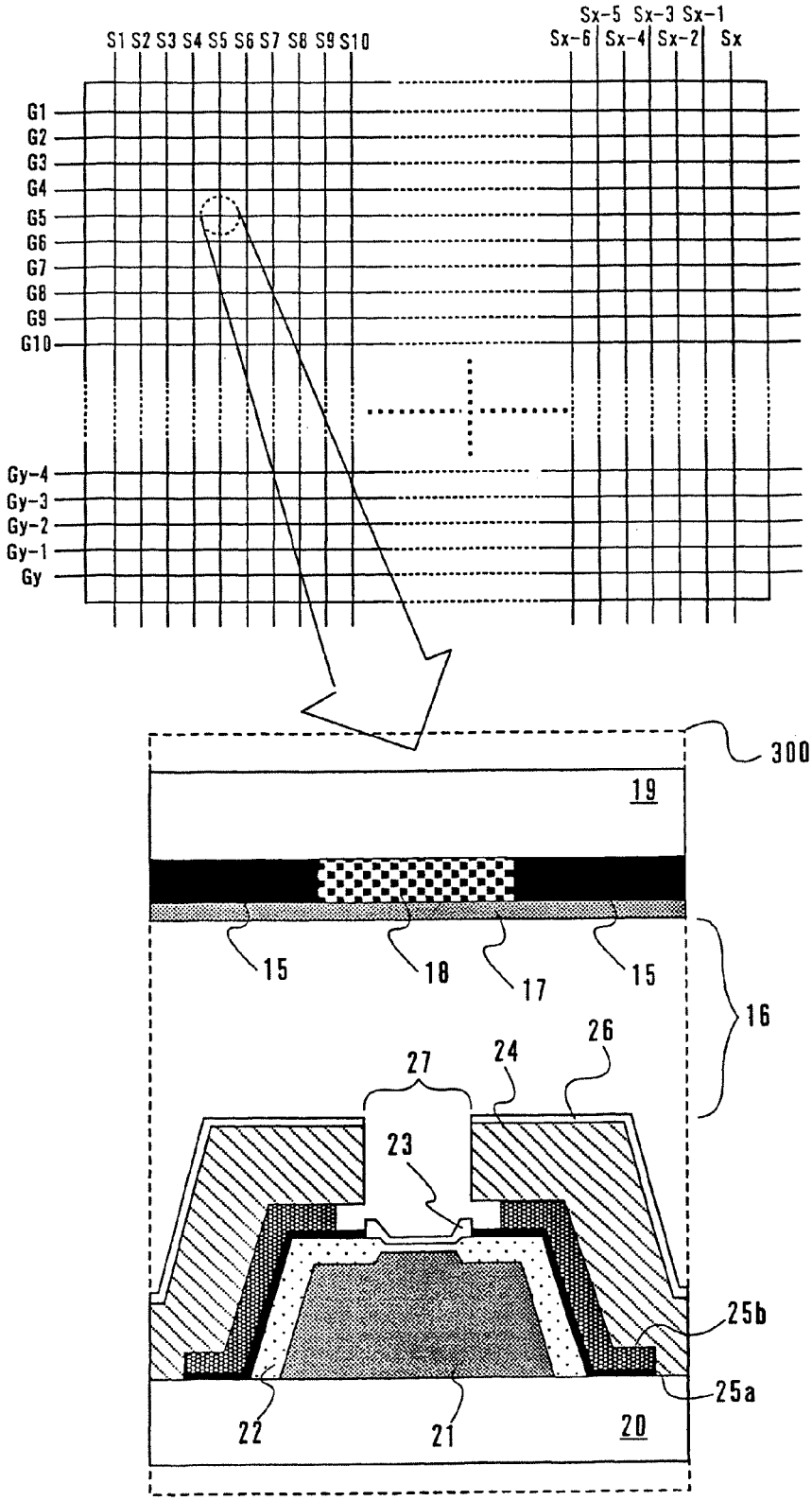
Fig. 7 (Prior Art)
FIG. 7 is a circuit diagram showing the constitution of pixel regions and a cross sectional view showing the constitution of a pixel in a conventional display device.
Figure 8:
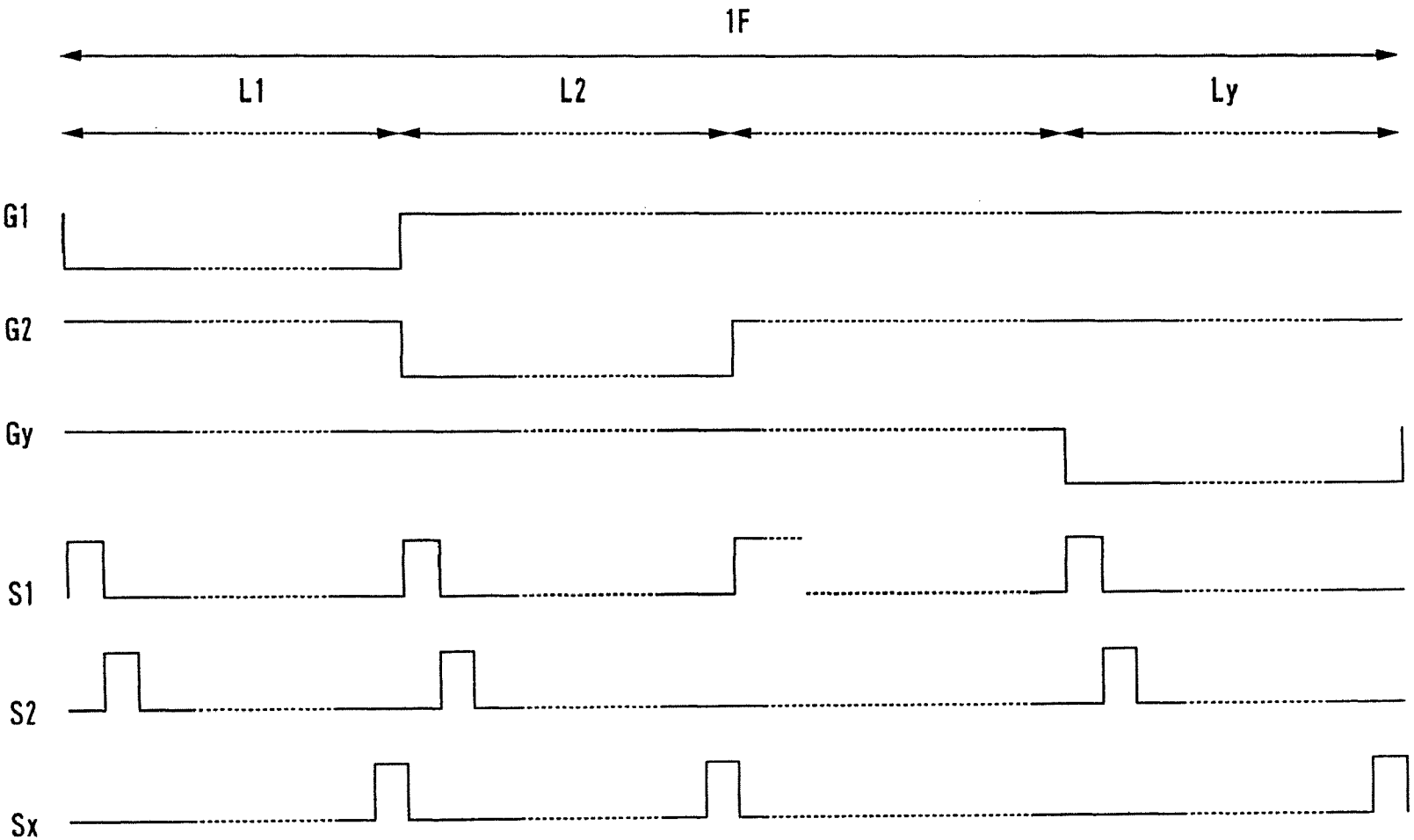
Fig. 8 (Prior Art)
FIG. 8 is a timing chart illustrating a method of driving a conventional display device.
Figure 9:
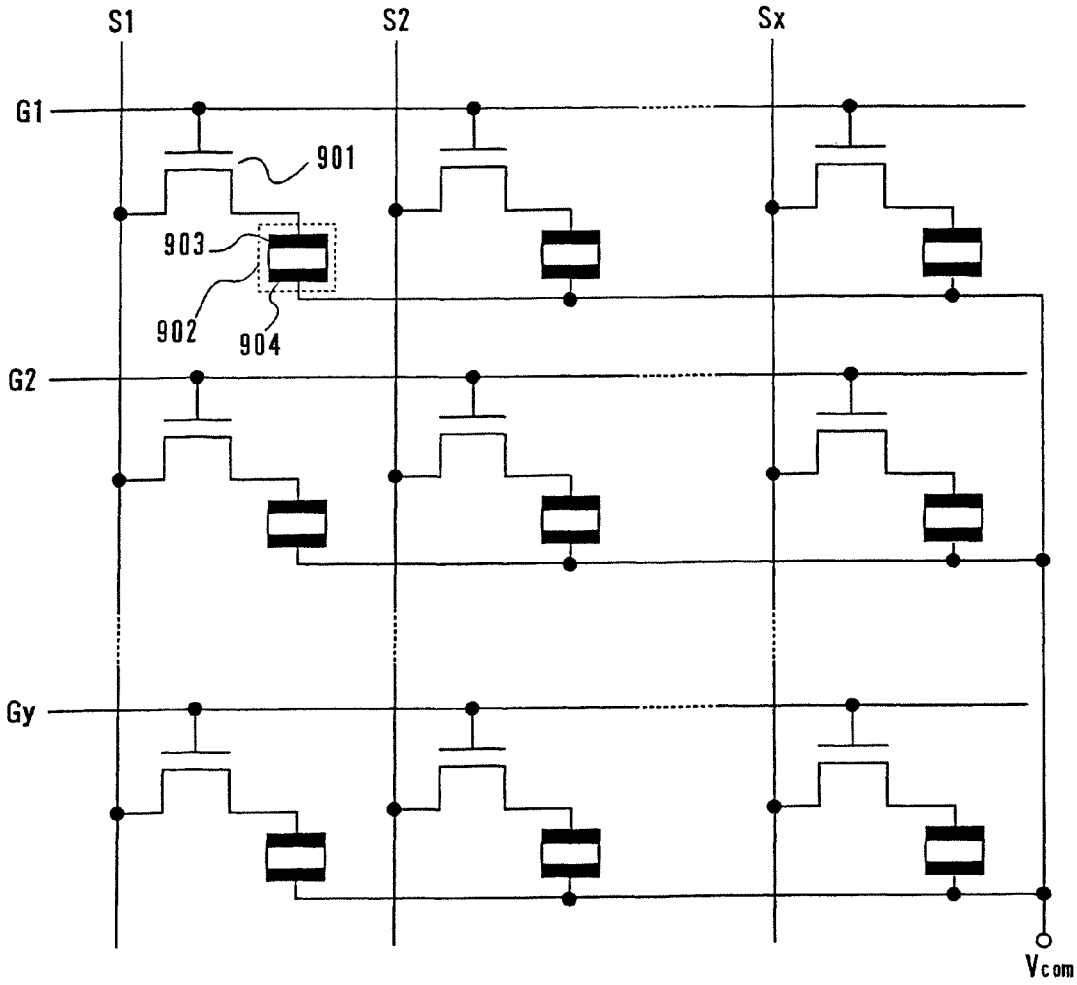
Fig. 9 (Prior Art)
FIG. 9 is a view showing the constitution of pixel regions in a conventional display device.

An element constructed in a manner shown in FIG. 6 can be used as the electron source element 104. In addition, the element is not limited to the electron source element shown in FIG. 6. The use of a known electron source element is possible.

Arranged in a pixel region are signal lines S1 to Sx successively arranged in a x-direction (row direction), power feed lines V1 to Vx, and scanning lines G1 to Gy successively arranged in a y-direction (column direction). Pixels are arranged on respective points of intersection of the plurality of scanning lines and signal lines.

The respective pixels comprise a switching TFT 101, a drive TFT 102, a storage capacitor 103, and the electron source element 104. One of a source region and a drain region of the switching TFT 101 is connected to one of the signal lines S1 to Sx, the other being connected to a gate electrode of the drive TFT 102 and one of electrodes of the storage capacitor 103. A gate electrode of the switching TFT 101 is connected to one of the scanning lines G1 to Gy. One of a source region and a drain region of the drive TFT 102 is connected to one of the power feed lines V1 to Vx, the other being connected to one 105 of the electrodes of the electron source element 104. That side of the storage capacitor 103, which is not connected to the gate electrode of the drive TFT 102, is connected to one of the power feed lines V1 to Vx.

In addition, a parasitic capacitance of the gate electrode of the drive TFT 102 can be made positive use of to substitute the storage capacitor 103.

Here, that one of the electrodes (upper electrode and lower electrode) of the electron source element 104, which is connected to the drive TFT 102, is referred to as a pixel electrode, and the other of the electrodes not connected to the drive TFT 102 is referred to as a facing electrode.

Facing electrodes 106 of the electron source elements 104 of all the pixels are given a predetermined electric potential $V_{com}$.

Signals input into the scanning lines G1 to Gy and the signal lines S1 to Sx are digital signals "0" or "1" corresponding to "Hi" or "Lo", respectively. In a pixel with the switching TFT 101 made ON by a signal from a scanning line, a digital signal from a signal line is input into the gate electrode of the drive TFT 102 to select a ON or OFF state of the drive TFT 102.

In addition, since a gate voltage of the drive TFT 102 is preserved by the storage capacitor 103, a pixel, in which a signal from a signal line is once input via the switching TFT 101 to make the drive TFT 102 ON, continues to be in a ON state until a signal is subsequently input into the gate electrode of the drive TFT 102 via the switching TFT 101.

In a pixel with the drive TFT 102 made ON, an electric potential of the power feed line is input into the electrode 105 of the electron source element 104 via between source/drain of the drive TFT 102. The power feed lines V1 to Vx are held at a power electric potential $V_{VL}$. Here, the electric potential $V_{com}$ of the facing electrode of the electron source element 104 and the power electric potential $V_{VL}$ are set so that when voltage corresponding to a difference therebetween is applied between the two electrodes of the electron source element 104, the electron source element emits electrons. Voltage corresponding to an electric potential difference between the electric potential $V_{com}$ of the facing electrode and the power electric potential $V_{VL}$, at which the electron source element emits electrons, is referred to as a drive voltage.

An ON or OFF state of the drive TFT 102 is switched over to thereby select whether drive voltage is applied between the pixel electrode 105 and the facing electrode 106 of the electron source element 104 or not. In this manner, whether or not the electron source element 104 emits electrons is selected, and so whether respective pixels are put in a light emitting or non-emitting state can be selected.

Figure 2:
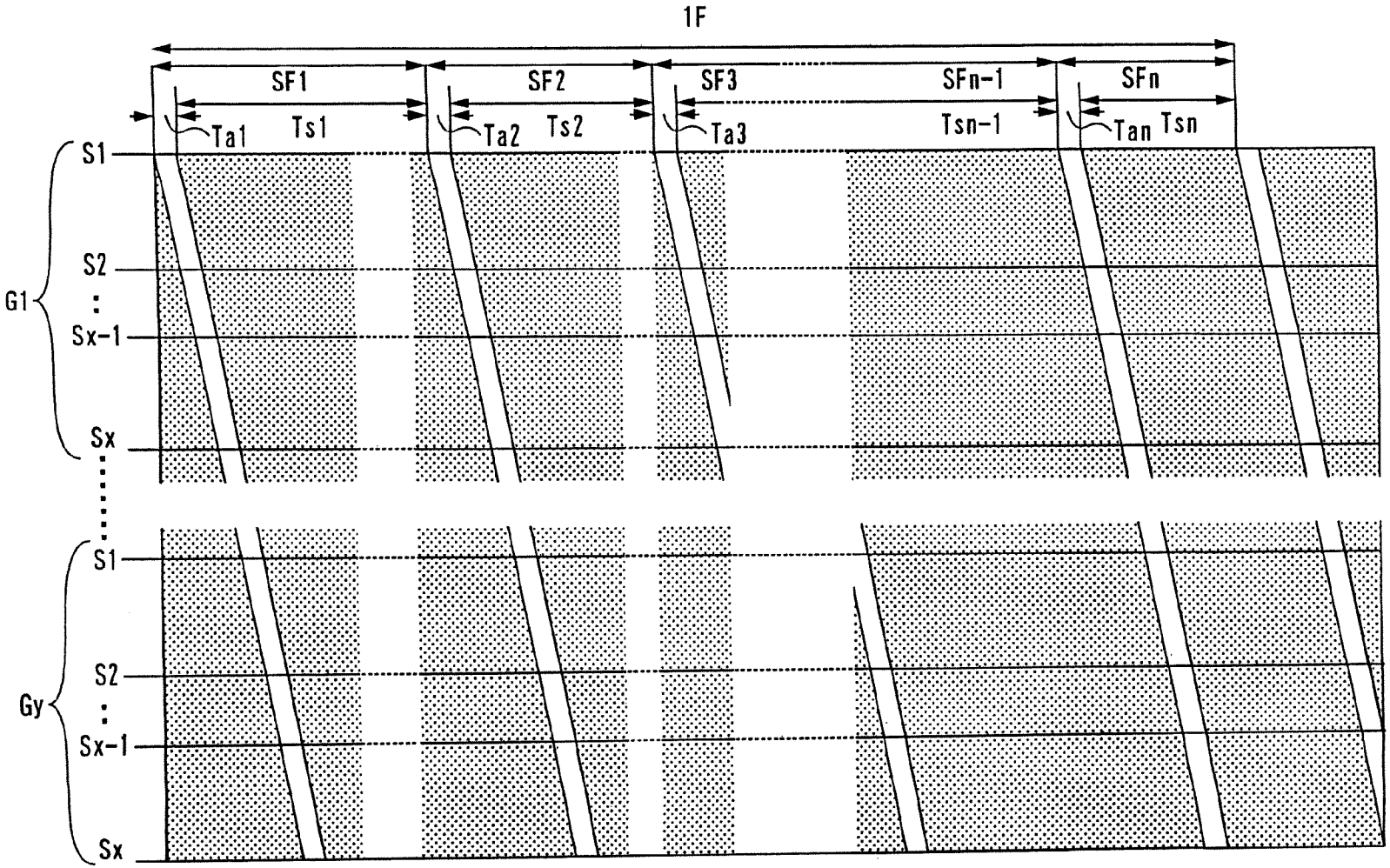
FIG. 2 is a timing chart illustrating a method of driving a display device according to the invention.

FIG. 2 shows a timing chart indicating a method of driving the display device constructed in the manner shown in FIG. 1.

Here, selection of a scanning line means a state, in which a TFT with a gate electrode connected to the scanning line is made ON.

One frame period is divided into a plurality of sub-frame periods SF1 to SFn. In a first sub-frame period, a scanning line G1 is selected and signals are sequentially input into the signal lines S1 to Sx. At this time, other scanning lines G2 to Gy are not selected. In this manner, an ON or OFF state of the drive TFTs 102 in a first column is selected and so a light emitting or non-emitting state of pixels in the first column is selected. Subsequently, only a scanning line G2 is selected and signals are sequentially input into the signal lines S1 to Sx. In this manner, an ON or OFF state of the drive TFTs 102 in a second column is selected and so a light emitting or non-emitting state of pixels in the second column is selected. The same procedure is repeated for all the scanning lines G1 to Gy and so a light emitting or non-emitting state of all the pixels is selected. A period, in which signals from the signal lines are input into the respective pixels and an ON or OFF state of the drive TFTs 102 is selected, is designated by a write period Ta. In particular, a write period in the first sub-frame period SF1 is designated by Ta1. In the write period Ta, a gate electrode of that drive TFT 102, for which an ON state is selected, continues to be held by the storage capacitor even after an associated switching TFT 101 is put in an OFF state. Accordingly, a pixel with that drive TFT 102, for which an ON state has been selected, continues to emit electrons after the write period has elapsed. A period, in which respective pixels perform display after the write period Ta, is designated by a display period Ts. In particular, a display period corresponding to the first sub-frame period is designated by Ts1. In this manner, the first sub-frame period SF1 is terminated.

In a second sub-frame period, an ON or OFF state of the drive TFTs 102 of all the pixels is selected in a write period Ta2 in the same manner as in the first sub-frame period, and a display period Ts2 is started.

The above action is repeated in all the sub-frame periods SF1 to SFn.

Gradation is represented by adding up periods, in which a light emitting state of the respective pixels is selected in display periods Ts1 to Tsn of respective sub-frame periods in one frame period.

Gradation can be represented in, for example, a display, in which n-bit digital signals are input to represent $2^n$ gradations, by dividing one frame period into n sub-frame periods SF1 to SFn and selecting a sub-frame period, in which a light emitting state comes out, where durations of display periods Ts1 to Tsn of respective sub-frame periods are $2^0:2^{-1}:2^{-2}:---:2^{-(n-2)}:2^{-(n-1)}$.

A way to set the above sub-frame periods will be explained by referring to a concrete example. In order to represent eight gradations, suppose that n is 3, one frame period is divided into three sub-frame periods SF1 to SF3, and durations of display periods of the sub-frame periods are Ts1:Ts2:Ts3=4:2:1. At this time, that pixel, in which a light emitting state of the pixel is selected in the sub-frame period SF1 and a light non-emitting state is selected in the other sub-frame periods SF2, SF3, represents luminance amounting to about 57% of luminance in the case where light is emitted in display periods of all the sub-frame periods. Meanwhile, that pixel, in which a light emitting state is selected only in SF3, represents luminance amounting to about 14% of luminance in the case where light is emitted in display periods of all the sub-frame periods.

In addition, a way to set sub-frame periods is not limited to the way described above.

In addition, the drive method (line sequential drive), in which signals are written into pixels in a column, may be carried out.

The invention can provide an FED, which is constructed in the above manner and can act with low power consumption and realize multi-graduations with high reliability.

EMBODIMENTS

Embodiment 1

The embodiment will be described in detail by way of an exemplary construction of a pixel in a display device according to the invention.

Figure 3:
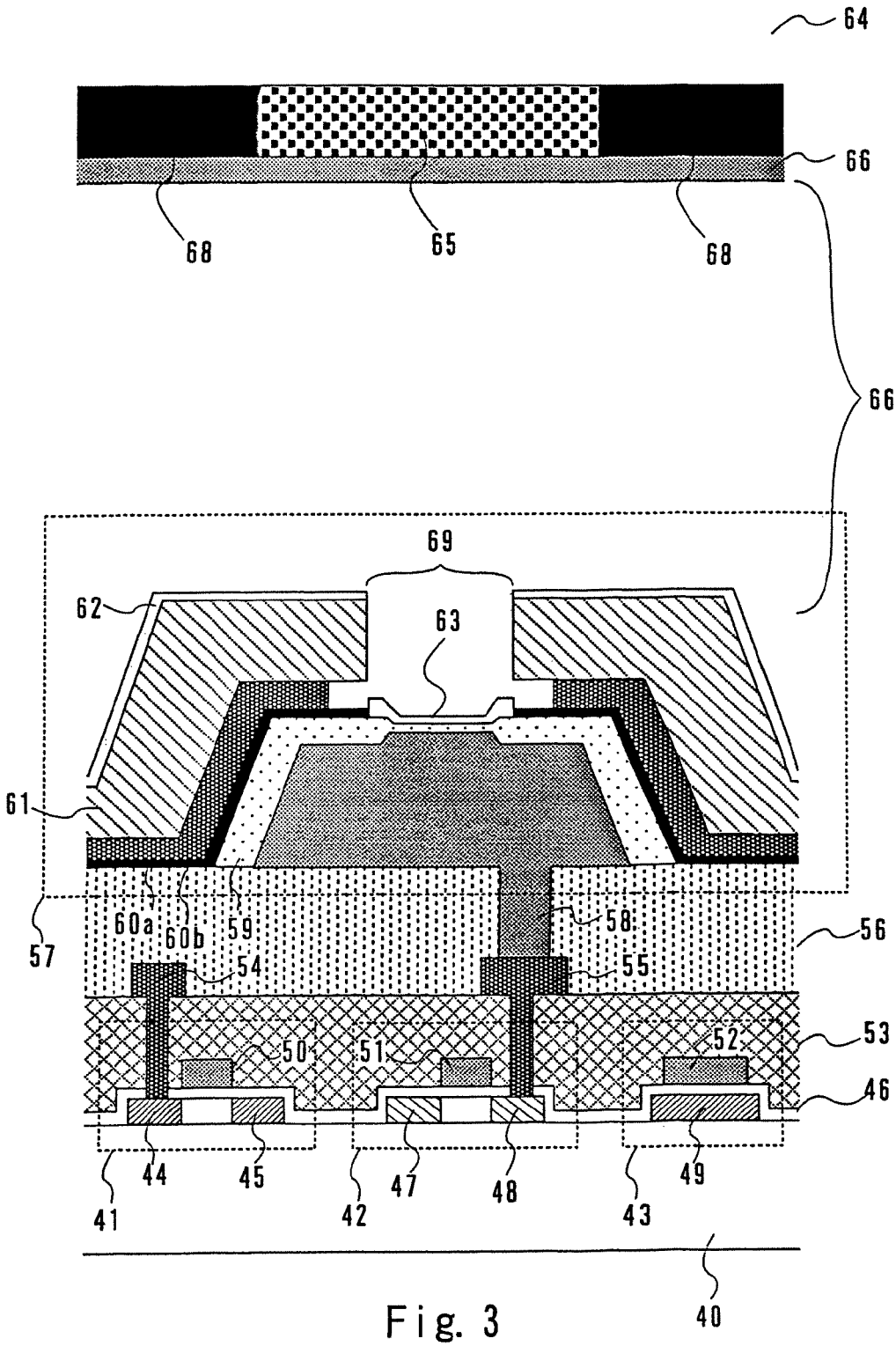
FIG. 3 is a cross sectional view showing the structure of a pixel in a display device according to the invention.

FIG. 3 is a cross sectional view showing a constructional example of a display device according to the invention. In FIG. 3, formed on a substrate 40 having an insulating surface are a switching TFT 41, a drive TFT 42, a storage capacitor 43, and an electron source element 57. The electron source element 57 is composed of a lower electrode 58, an upper electrode 63, and an insulating film 59 interposed between the lower electrode 58 and the upper electrode 63, these parts being on a interlayer film 56 formed of an insulating material. Here, the reference numeral 46 denotes a gate insulating film, 53 a interlayer film, 61 a protective insulating layer, 60*a* a contact electrode, 60*b* an upper electrode bus line, and 62 a protective electrode.

A gate voltage 50 of the switching TFT 41 is connected to a scanning line (not shown). An impurity region 44 of the switching TFT is connected to a signal line 54, and an impurity region 45 is connected to a gate electrode 51 of the drive TFT 42 and one 52 of electrodes of the storage capacitor 43. The other 49 of the electrodes of the storage capacitor 43 is connected to a power feed line (not shown) by way of wiring. An impurity region 47 of the drive TFT is connected to a power feed line (not shown) by way of wiring, and an impurity region 48 is connected to the lower electrode 58 of the electron source element 57 through an electrode 55. The upper electrodes 63 of the electron source elements 57 in all the pixels are given a predetermined electric potential through the contact electrodes 60*a* and the upper electrode bus lines 60*b*.

Here, impurity regions correspond to source regions or drain regions of TFTs. In addition, in the case where the impurity region 44 is a source region, the impurity region 45 corresponds to a drain region, and in the case where the impurity region 44 is a drain region, the impurity region 45 corresponds to a source region. Likewise, in the case where the impurity region 47 is a source region, the impurity region 48 corresponds to a drain region, and in the case where the impurity region 47 is a drain region, the impurity region 48 corresponds to a source region.

While a pixel electrode defines the lower electrode 58 in FIG. 3, it may be the upper electrode. In this case, the lower electrodes in all pixels are given a predetermined electric potential.

The switching TFT 41 and the drive TFT 42 may be an n-channel type TFT or a p-channel type TFT.

A substrate 64 is provided in a manner to face a surface, on which the electron source elements 57 on the substrate 40 is provided. In addition, the substrate 64 is light-transmissive. Arranged on the substrate 64 is a fluorescent body 65 opposite to an electron emitting region 69 of the electron source elements 57. A black matrix 68 is arranged around the fluorescent body 65. In addition, the fluorescent body 65 is formed on a surface thereof with a metal-backed layer 66. Vacuum is kept in a region 66 between the substrate 40 and the substrate 64.

Known methods may be used to fabricate the switching TFT 41, the drive TFT 42 and the storage capacitor 43. Also, when these TFTs are formed, the interlayer film 56 formed of an insulating material is formed, and the electron source element is formed thereon. At this time, it is required that materials and thicknesses for the interlayer films 53, 56 be chosen to adequately lessen irregularities caused by the switching TFT 41, the drive TFT 42, the storage capacitor 43, the wirings 54, 55 and the like to provide flat surfaces.

The electron source element 57 is formed on the flattened insulating surface. In addition, a contact hole connecting to the wiring 55 of the drive TFT 42 may be formed on the flattened interlayer film 56 prior to formation of the electron source element so as to connect the lower electrode to the wiring 55 of the drive TFT 42. Alternatively, the lower electrode may be formed after the wiring for connection of the lower electrode and the wiring 55 of the drive TFT 42 is formed. Known methods may be used to fabricate the electron source element 57.

Here, the lower electrode 58 of the electron source element 57 can be made use of as a shielding film for respective TFTs (the switching TFT 41, the drive TFT 42) of pixels. In addition, an electron source element must not necessarily be arranged to overlap TFTs (a switching TFT, a drive TFT), which constitute a pixel.

Since a method of driving the display device constructed in the above manner is the same as that shown in the embodiment, any explanation thereof is omitted here.

Since electron source elements are arranged to overlap TFTs of respective pixels in the display device constructed according to the embodiment, it is possible to form fine pixels.

In addition, while a display (FED) is exemplarily shown in the embodiment, in which signals input into electrodes of an MIM type electron source element constructed in the manner shown in FIG. 3 are operated by means of two TFTs and a storage capacitor to perform display, the invention can be applied to known electron source elements constructed in other manners, such as an MIM type electron source element constructed in the other manner, electron source elements constructed in other manner than those of MIM type ones and the like.

Embodiment 2

An explanation will be given to a display device having pixels constructed in a different manner from that of pixels shown in the above embodiment.

Figure 4:
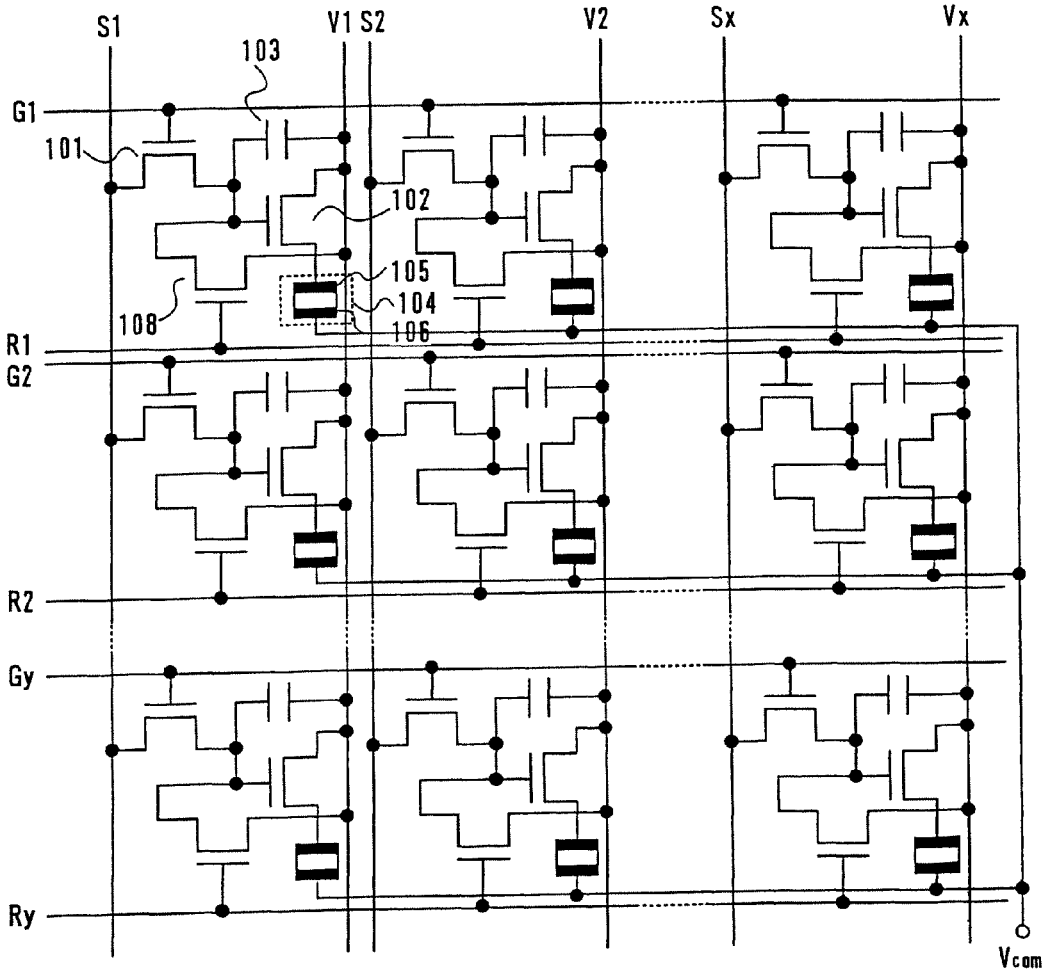
FIG. 4 is a view showing the structure of pixel regions in a display device according to the invention.

FIG. 4 shows a constitution of a pixel region of the display device according to the present embodiment. Arranged in the pixel region are signal lines S1 to Sx, scanning lines G1 to Gy, power feed lines V1 to Vx, and reset signal lines R1 to Ry. Respective pixels comprise a switching TFT (first TFT) 101, a drive TFT (second TFT) 102, an erase TFT (third TFT) 108, an electron source element 104, and a storage capacitor 103.

In respective pixels, one of a source region and a drain region of the switching TFT 101 is connected to one of the signal lines S1 to Sx, and the other is connected to a gate electrode of the drive TFT 102 and one of electrodes of the storage capacitor 103. The other of the electrodes of the storage capacitor 103 is connected to one of the power feed lines V1 to Vx, and a gate electrode of the switching TFT 101 is connected to one of the scanning lines G1 to Gy. One of a source region and a drain region of the drive TFT 102 is connected to one of the power feed lines V1 to Vx, and the other is connected to the lower electrode 105 of the electrodes of the electron source element 104. A gate electrode of the erase TFT 108 is connected to one of the reset signal lines R1 to Ry, and one of a source region and a drain region of the erase TFT 108 is connected to the gate electrode of the drive TFT 102, and the other is connected to one of the power feed lines V1 to Vx.

In FIG. 4, pixel electrodes serve as lower electrodes, and upper electrodes in all the pixels are given a predetermined electric potential. However, pixel electrodes may serve as upper electrodes. In this case, lower electrodes in all the pixels are given a predetermined electric potential.

The switching TFT, the drive TFT and the erase TFT may be an n-channel type TFT or a p-channel type TFT.

A method of driving the display device constructed in the above manner will be described with reference to a timing chart shown in FIG. 5.

Since a process, in which the electron source element 104 emits electrons in a state, in which charge is preserved on the storage capacitor 103 of the respective pixels and the drive TFT 102 is made ON, is the same as that shown in the previous embodiment, an explanation is omitted here. In addition, it is assumed that the erase TFT 108 is put in an OFF state when a signal is written in the storage capacitor 103 from the signal lines S1 to Sx.

Figure 5:
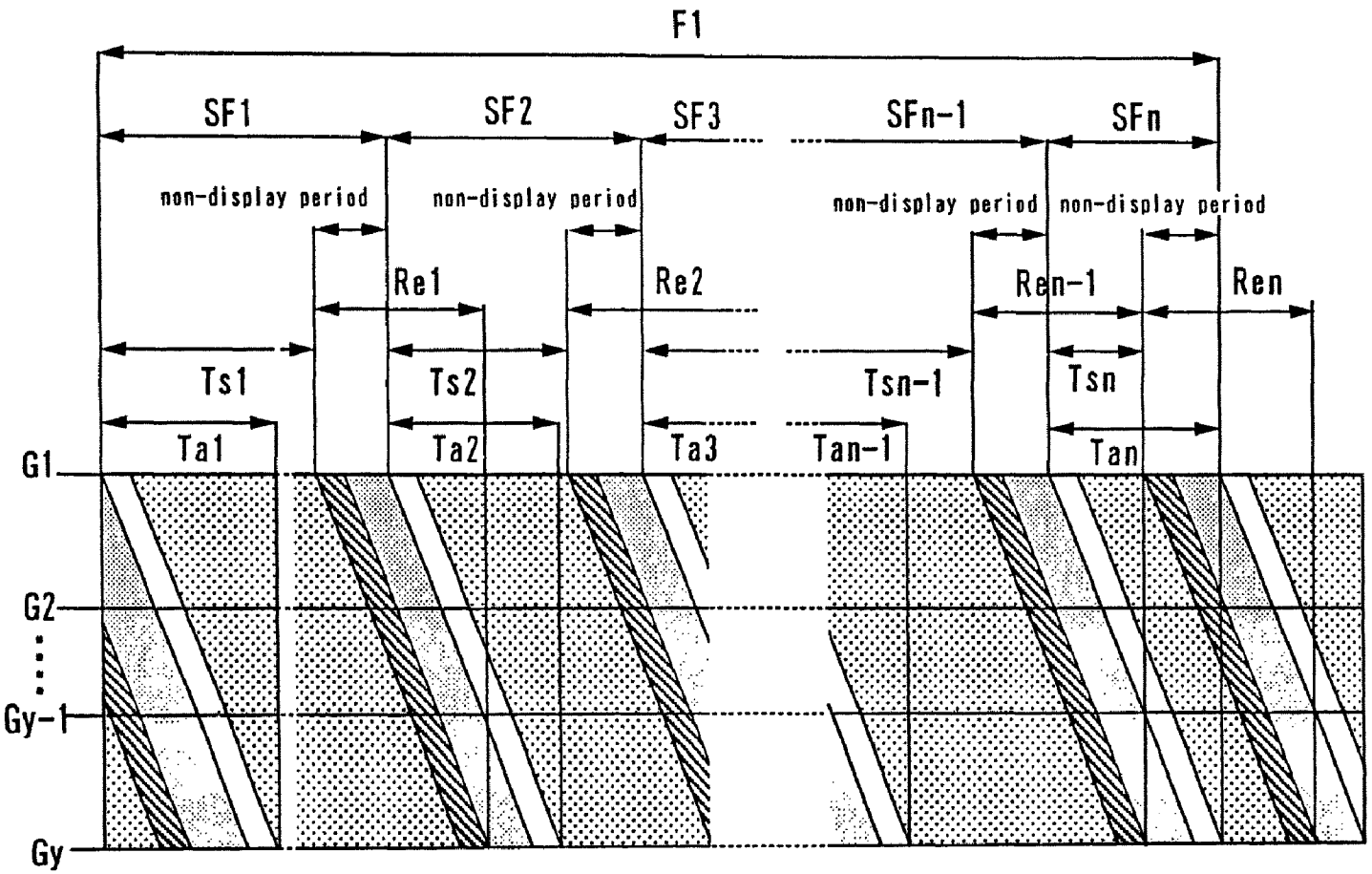
FIG. 5 is a timing chart illustrating a method of driving a display device according to the invention.

In FIG. 5, while the scanning lines G1 to Gy are sequentially selected, it is correspondingly assumed that the signal lines S1 to Sx are sequentially selected (dot sequential drive).

In addition, the drive method (line sequential drive), in which signals are written into pixels in a column, may be carried out.

Charge is preserved on the storage capacitors 103 of the respective pixels and the drive TFTs 102 are made ON. In this manner, the electron source elements 104 emit electrons. Thus after the lapse of a write period Ta, a display period Ts is started. When a predetermined time has elapsed after the display period Ts was started, signals input into the reset signal lines R1 to Ry make the erase TFTs 108 ON. Then two electrodes of the respective storage capacitors 103 are short-circuited, so that charge accumulated in the storage capacitors 103 is discharged. Thus the drive TFTs 102 are made OFF. Such action is referred to as a reset action. Also, periods, during which the reset action is performed, are referred to as reset periods, and indicated by Re1 to Ren in the figure.

In the present embodiment, the erase TFTs 108 are provided for the reset action, whereby pixels can be put in a light non-emitting state (indicated as a non-display period in FIG. 5) until a next write period is started.

In the method of driving a display device composed of pixels constructed in the manner shown in FIG. 1, signals are not normally input into respective pixels when a write period in a sub-frame period overlaps a write period in a different sub-frame period. Therefore, while there has been a need of setting in one sub-frame period a display period Ts longer than a period (write period Ta) required for inputting signals into all pixels, the use of a display device constructed in the manner shown in FIG. 4 makes it possible to set a display period Ts in one sub-frame period to be shorter than a period required for inputting signals into all pixels.

The present embodiment can be put to practice in combination with the first embodiment.

Embodiment 4

In this embodiment, an example of a signal line drive circuit is shown to input signals into signal lines in a display device according to the invention.

In addition, an example of a signal line drive circuit is shown in the case of using a drive method (dot sequential drive), in which a signal is input one pixel by one pixel.

Figure 10:
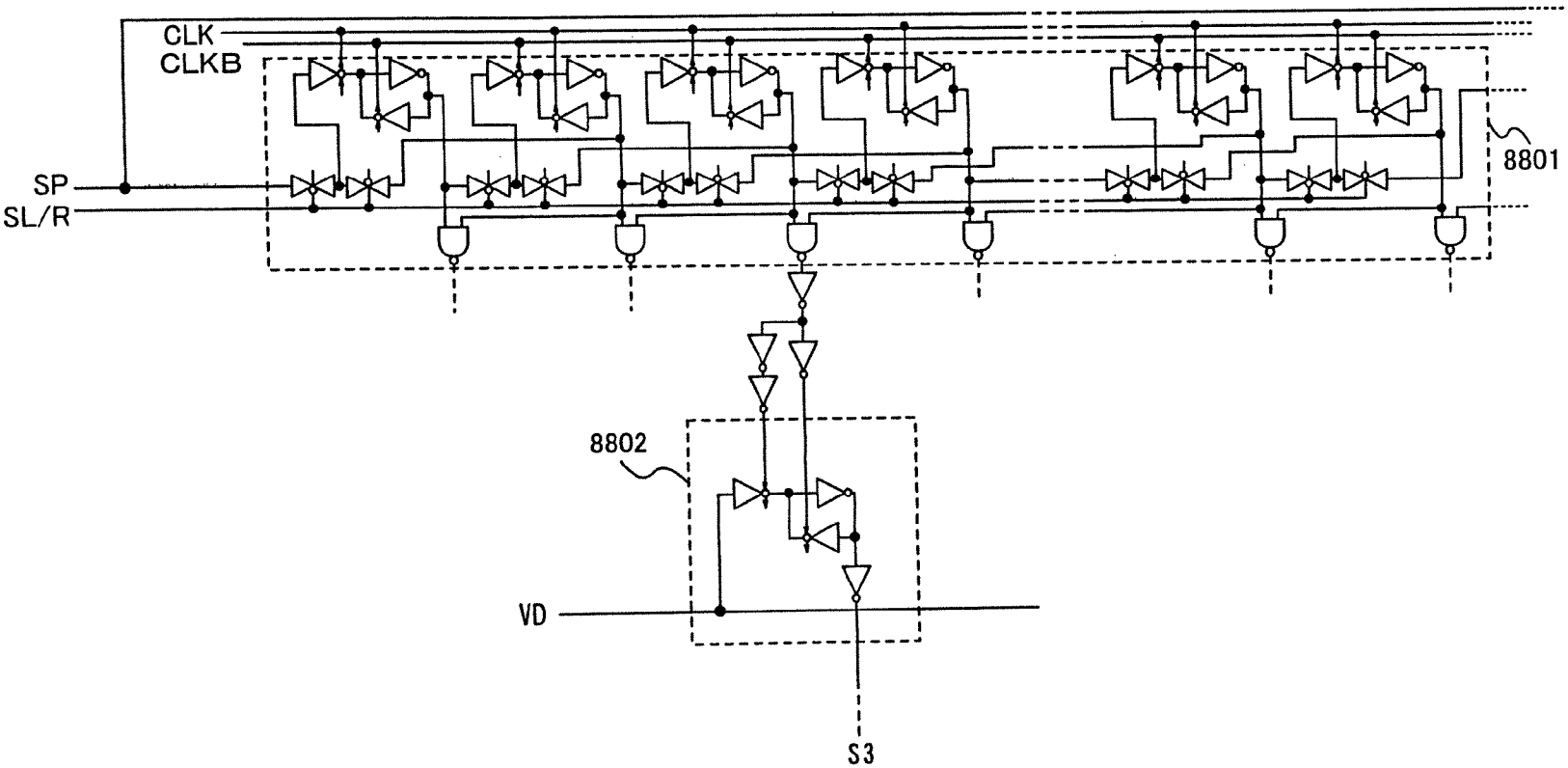
FIG. 10 is a view showing the constitution of a signal line drive circuit in a display device according to the invention.

FIG. 10 shows the constitution of a signal line drive circuit. The signal line drive circuit is composed of a shift register 8801, and a latch circuit 8802. Circuits constructed in a known manner can be freely used for the shift register 8801 and the latch circuit 8802.

Here, while FIG. 10 typically shows only the latch circuit 8802 corresponding to a signal line S3, latch circuits 8802 are provided for all signal lines S1 to Sx.

Input into the shift register 8801 are a clock pulse CLK, reversed clock pulse CLKB, in which the clock pulse CLK is reversed, a start pulse SP, and a scanning direction switching signal SL/R. Thus sampling pulses are output from NAND circuits provided in respective stages of the shift register 8801. Digital signals are input into the latch circuit 8802 from a digital signal input line VD, and sequentially preserved by the latch circuit 8802 in accordance with sampling pulses output from the shift register 8801. Thus digital signals are sequentially output to the respective signal lines.

The signal line drive circuit can be formed on a substrate having an insulating surface with the use of TFTs. TFTs constituting the signal line drive circuit can be formed together with respective TFTs (switching TFTs, drive TFTs), which constitute pixels.

Wiring capacity and wiring resistance between pixels and the signal line drive circuit can be sharply reduced by forming pixels and the signal line drive circuit on the same substrate. Also, a display device is low in manufacturing cost and can be made small in size.

In addition, while the signal line drive circuit having shift registers is cited by way of example in the present embodiment, decoders or the like may be used for the signal line drive circuit in the invention.

The present embodiment can be freely put to practice in combination with the first and second embodiments.

Embodiment 4

Figure 11:
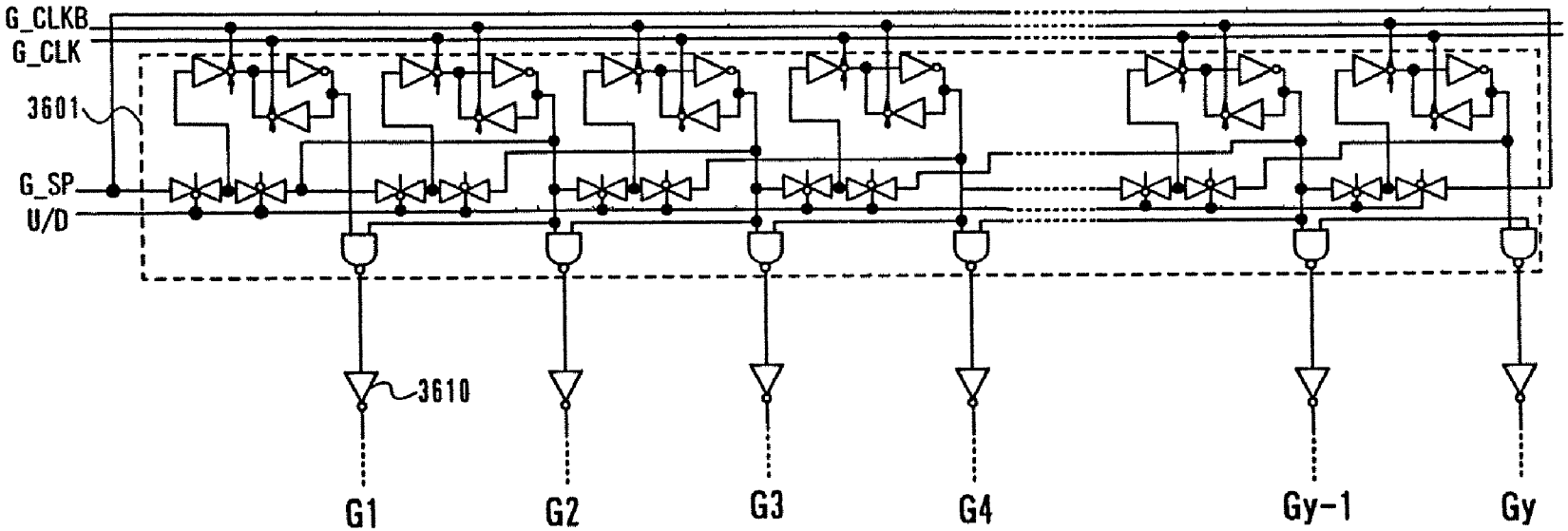
FIG. 11 is a view showing the constitution of a scanning line drive circuit in a display device according to the invention.

In this embodiment, FIG. 11 shows an example of a scanning line drive circuit, by which signals are input into signal lines in a display device according to the invention.

The scanning line drive circuit is composed of a shift register 3601 and buffers 3610.

Input into the shift register 3601 are a clock pulse G_CLK, reversed clock pulse G_CLKB, in which the clock pulse G_CLK is reversed, a start pulse G_SP, and a scanning direction switching signal U/D. Thus pulses are sequentially output from NAND circuits provided in respective stages of the shift register 3601. These pulses are output to the scanning lines G1 to Gy via the buffers 3610. In this manner, the scanning line drive circuit selects signal lines one by one.

The scanning line drive circuit can be formed on a substrate having an insulating surface with the use of TFTs. TFTs constituting the scanning line drive circuit can be formed together with respective TFTs (switching TFTs, drive TFTs), which constitute pixels.

Wiring capacity and wiring resistance between pixels and the scanning line drive circuit can be sharply reduced by forming pixels and the scanning line drive circuit on the same substrate. Also, a display device is low in manufacturing cost and can be made small in size.

In addition, a drive circuit, by which signals are input into the reset signal lines, in a display device having pixels shown in the second embodiment can make use of a circuit constructed in the same manner as the scanning line drive circuit.

In addition, while the scanning line drive circuit having shift registers is cited by way of example in the present embodiment, decoders or the like may be used for the scanning line drive circuit in the invention.

The present embodiment can be freely put to practice in combination with the first, second and third embodiments.

Embodiment 5

In this embodiment, an electronic equipment making use of the display device according to the invention will be described with reference to FIGS. 12A to 12B.

Figure 12A:
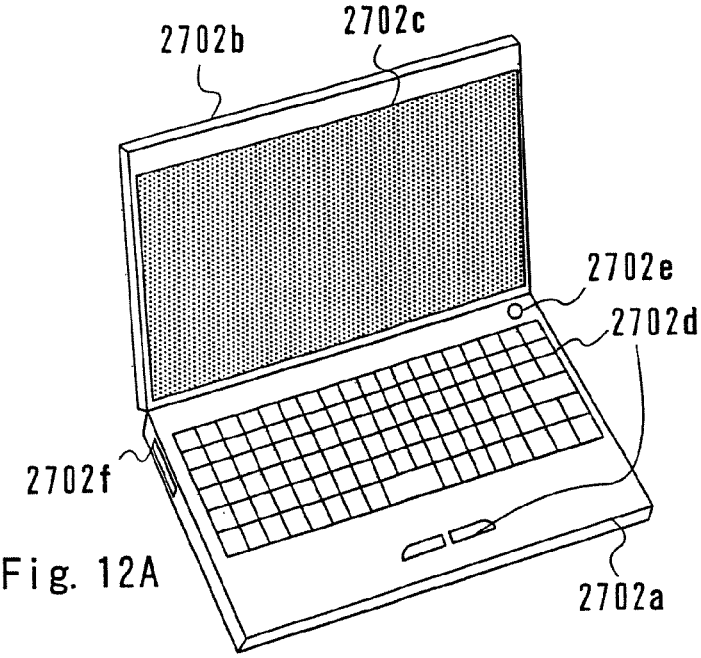
FIGS. 12A to C are views showing an electronic equipment, to which a display device according to the invention is applied.

FIG. 12A schematically shows a personal computer making use of the display device according to the invention. The computer is composed of a body 2702*a*, housing 2702*b*, display device 2702*c*, operating switch 2702*d*, power switch 2702*e*, and an external input port 2702*f*. The display device according to the invention can be used in the display device 2702*c*.

Figure 12B:
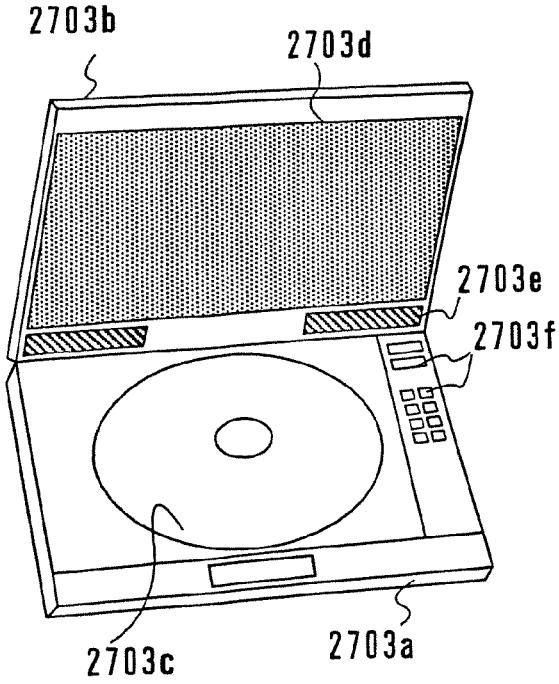

FIG. 12B schematically shows an image regeneration apparatus making use of the display device according to the invention. The image regeneration apparatus is composed of a body 2703*a*, housing 2703*b*, recording medium 2703*c*, display device 2703*d*, sound output unit 2703*e*, and an operating switch 2703*f*. The display device according to the invention can be used in the display device 2703*d*.

Figure 12C:
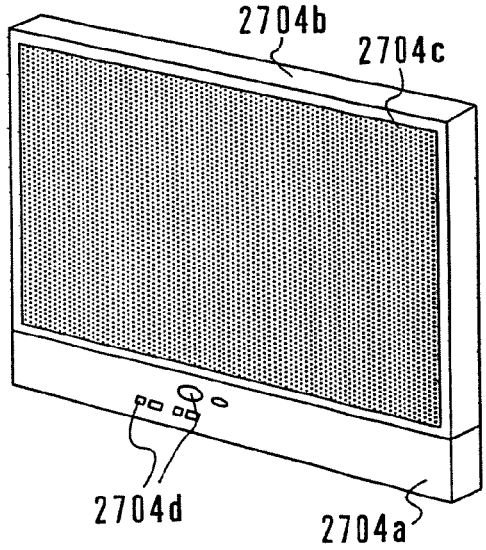

FIG. 12C schematically shows a television receiver making use of the display device according to the invention. The television receiver is composed of a body 2704*a*, housing 2704*b*, display device 2704*c*, and an operating switch 2704*d*. The display device according to the invention can be used in the display device 2704*c*.

The invention is not limited to the above-mentioned electronic equipments but can be applied to various electronic equipments.

The present embodiment can be freely put to practice in combination with the first, second, third and fourth embodiments.

Embodiment 6

In this embodiment, an explanation will be given to the structure of drive TFTs provided in respective pixels of the display device according to the invention. In addition, since the pixels are structured in the same manner as in the preferred embodiments and the second embodiment, an explanation is omitted here.

Voltage for driving of an electron source element is high relative to voltage required for causing an element, which makes use of electroluminescent effect, to emit light. Therefore, with the display device according to the invention, high voltage is applied to TFTs arranged on respective pixels, in particular, drive TFTs connected in series to an electron source element. Accordingly, TFTs of high voltage endurance are used in order to improve reliability.

An explanation will be given to the structure of drive TFTs provided in respective pixels. Here, an example is shown, in which drive TFTs are n-channel type TFTs. Also, an example is shown, in which a drain region of the n-channel type drive TFT is connected to an electrode of an electron source element, and a source region thereof is connected to a power feed line.

Figure 13A:
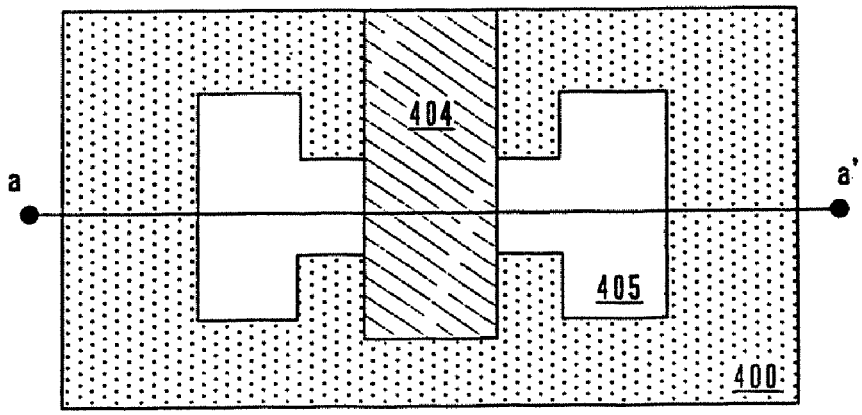
FIGS. 13A and B are views showing the constitution of a drive TFT in a pixel of a display device according to the invention.
Figure 13B:
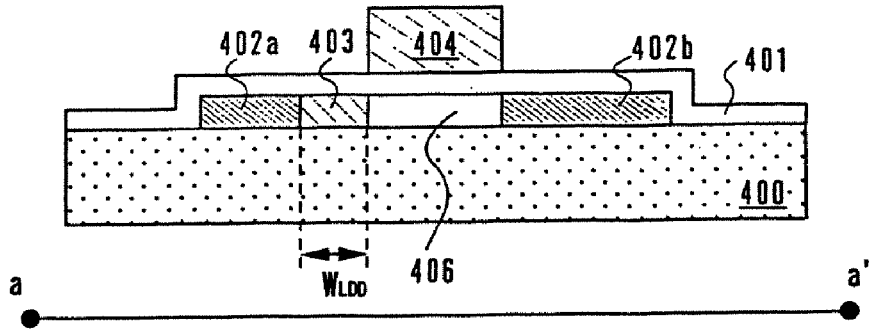

FIG. 13A is a top plan view showing the constitution of a TFT provided in respective pixels of the display device according to the invention. FIG. 13B is a cross sectional view taken along the line a-a' in FIG. 13A. The same parts in FIG. 13A and FIG. 13B are denoted by the same reference numerals. In addition, the figures omit a interlayer film formed on a TFT, wirings (source wiring, drain wiring) for electric connection to a source region and a drain region, an electron source element, and the like.

The reference numeral 400 denotes a substrate having an insulating surface. 405 a semiconductor active layer, 404 a gate electrode and 401*a* gate insulating film. The semiconductor active layer 405 includes a first impurity region 402 (402*a*, 402*b*), second impurity region 403, and a channel region 406. The first impurity region 402*a* corresponds to a drain region. Also, the region 402*b* corresponds to a source region. The second impurity region 403 is one (referred below to as a LDD region) having a low impurity concentration for determination of conductive type, relative to the first impurity region 402. Thus the TFT can be increased in voltage endurance by providing such LDD region on a side of the drain region. In addition, it is desired that the LDD region have a width (denoted by $W_{LDD}$ in FIG. 13B) of around 2 μm to 6 μm.

While an explanation has been given to the case where the drive TFT is a n-channel type drive TFT, the invention can be applied to the case where the drive TFT is a p-channel type drive TFT.

In this manner, a display device having a high reliability is obtained.

The present embodiment can be freely put to practice in combination with the first to fifth embodiments.

A display device according to the invention having an electron source element, from which electrons are emitted by applying a voltage between a first electrode and a second electrode, has a feature in that it comprises a capacitor element, a first signal line, a switch, by which connection of one of electrodes of the capacitor element and the first signal line is selected, and an element for varying an electric potential of the first electrode of the electron source element in accordance with a voltage preserved in the capacitor element. With the above constitution, there is provided the FED with low power consumption and high reliability.

A method, according to the invention, of driving a display device having an electron source element, from which electrons are emitted by applying a voltage between two electrodes, comprises selectively inputting an electric potential of a signal, which is input into a signal line, into one of electrodes of a capacitor element, to cause the capacitor element to preserve a predetermined voltage. Connection between a power line and one of the electrodes of the electron source element is selected in accordance with a voltage thus preserved. A potential difference is given between an electric potential of the one of the electrodes of the electron source element connected to the power line and an electric potential of the other of the electrodes. Thereby the electron source element emits electrons, and the electric potential thus emitted is incident upon a fluorescent body. Thus the fluorescent body emits light, and pixels are put in a light emitting state. A method of driving the FED with low power consumption and high reliability and capable of multi-graduations can be provided in the above manner thus constituted.

What is claimed is:

1. A display device having a pixel portion, a signal line driver circuit, and a scanning line driver circuit, each pixel in the pixel portion comprising:

an electron source element including a first electrode and a second electrode;

a capacitor element;

a first signal line;

a first switch configured to select connection of one of electrodes of the capacitor element and the first signal line;

a second switch configured to vary an electric potential of the first electrode of the electron source element in accordance with a voltage preserved in the capacitor element; and a third switch configured to short-circuit the electrodes of the capacitor element, wherein the pixel portion, the signal line driver circuit, and the scanning line driver circuit are provided on a same substrate.

2. The display device according to claim 1, wherein the electron source element further comprises an insulating layer between the first electrode and the second electrode.

3. An electronic equipment having the display device according to claim 1, wherein the electronic equipment is selected from the group consisting of a personal computer, an image regeneration apparatus, and a television.

4. A display device having a pixel portion, a signal line driver circuit, and a scanning line driver circuit, each pixel in the pixel portion comprising:

an electron source element, from which electrons are emitted by applying a voltage between a first electrode and a second electrode;

a first signal line;

a second signal line;

a third signal line;

a first switch;

a second switch; and a third switch, wherein the first switch is electrically connected to the second signal line, the second switch, and the first signal line, wherein the second switch is electrically connected to the third signal line and one of the first and second electrodes of the electron source element, wherein the third switch is electrically connected to the second switch and the third signal line, and wherein the pixel portion, the signal line driver circuit, and the scanning line driver circuit are provided on a same substrate.

5. The display device according to claim 4, wherein the second switch is electrically connected to the first electrode of the electron source element.

6. The display device according to claim 4, wherein the second switch is electrically connected to the second electrode of the electron source element.

7. The display device according to claim 4, wherein the each pixel further comprises a capacitor element having a third electrode and a fourth electrode to preserve voltage, and wherein the third electrode is connected to the third signal line, and the fourth electrode is connected to the second switch.

8. An electronic equipment having the display device according to claim 4, wherein the electronic equipment is selected from the group consisting of a personal computer, an image regeneration apparatus, and a television.

9. A display device having a pixel portion, a signal line driver circuit, and a scanning line driver circuit, each pixel in the pixel portion comprising:

an electron source element, which comprises a first electrode, a second electrode, and an insulating layer between the first electrode and the second electrode, and in which the first electrode is higher in electric potential than the second electrode and the first electrode emits electrons;

a first signal line;

a second signal line;

a third signal line;

a first switch; and a second switch, wherein the first switch is electrically connected to the second signal line, the second switch, and the first signal line, wherein the second switch is electrically connected to the third signal line and one of the first and second electrodes of the electron source element, and wherein the pixel portion, the signal line driver circuit, and the scanning line driver circuit are provided on a same substrate.

10. The display device according to claim 9, wherein the second switch is electrically connected to the first electrode of the electron source element.

11. The display device according to claim 9, wherein the second switch is electrically connected to the second electrode of the electron source element.

12. The display device according to claim 9, wherein the each pixel further comprises a capacitor element having a third electrode and a fourth electrode to preserve voltage, and wherein the third electrode is connected to the third signal line, and the fourth electrode is connected to the second switch.

13. An electronic equipment having the display device according to claim 9, wherein the electronic equipment is selected from the group consisting of a personal computer, an image regeneration apparatus, and a television.

14. A method of driving a display device having an electron source element, which comprises a first electrode, a second electrode, and an insulating layer between the first electrode and the second electrode, and in which the first electrode is higher in electric potential than the second electrode and the first electrode emits electrons, the method comprising the steps of:

inputting a first signal into a first switch to select an ON state of the first switch;

inputting a second signal through the first switch into a second switch to select an ON state of the second switch;

inputting an electric potential of a power source into one of the first and second electrodes of the electron source element through the second switch; and causing the electron source element to emit electrons.

15. The method according to claim 14, wherein the electric potential of the power source is inputted into the first electrode of the electron source element through the second switch.

16. The method according to claim 14, wherein the electric potential of the power source is inputted into the second electrode of the electron source element through the second switch.

17. The method according to claim 14, wherein the second signal is input into the second switch several times during one frame period.

18. The method according to claim 14, wherein the display device is incorporated in an electronic equipment selected from the group consisting of a personal computer, an image regeneration apparatus, and a television.

19. A method of driving a display device having an electron source element, from which electrons are emitted by applying a voltage between a first electrode and a second electrode, the method comprising the steps of:

inputting a first signal into a first switch to select an ON state of the first switch;

inputting a second signal through the first switch into a second switch to select an ON state of the second switch;

using a capacitor element to preserve a voltage of the second switch determined by the second signal;

inputting an electric potential of a power source into the first electrode of the electron source element through the second switch;

causing the electron source element to emit electrons;

making a third switch, which is connected in parallel to the capacitor element, ON to discharge charge preserved by the capacitor element to make the second switch OFF; and causing the electron source element not to emit electrons.

20. The method according to claim 19, wherein the display device is incorporated in an electronic equipment selected from the group consisting of a personal computer, an image regeneration apparatus, and a television.

* * * * *